US005901787A

United States Patent [19]

Boyle

[11] Patent Number: 5,901,787

[45] Date of Patent: May 11, 1999

[54] METAL SEALING WIRELINE PLUG

[75] Inventor: Colin S. Boyle, Aberdeen, United Kingdom

[73] Assignee: Tuboscope (UK) Ltd., Aberdeen, United Kingdom

[21] Appl. No.: 08/833,318

[22] Filed: Apr. 4, 1997

Related U.S. Application Data

[63] Continuation-in-part of application No. 08/489,043, Jun. 9, 1995.

[51] Int. Cl.[6] ..... E21B 33/128

[52] U.S. Cl. ..... 166/135; 166/203

[58] Field of Search ..... 166/120, 135, 166/182, 192, 203

[56] References Cited

U.S. PATENT DOCUMENTS

| | | | |
|---|---|---|---|
| 3,138,207 | 6/1964 | Peppers . | |
| 3,208,531 | 9/1965 | Tamplen . | |
| 4,058,162 | 11/1977 | Smith | 166/135 |
| 4,127,168 | 11/1978 | Hanson et al. . | |
| 4,178,992 | 12/1979 | Regan et al. . | |
| 4,302,018 | 11/1981 | Harvey et al. . | |
| 4,651,818 | 3/1987 | Johnson et al. . | |
| 4,901,794 | 2/1990 | Baugh et al. . | |
| 4,907,651 | 3/1990 | Bou-Mikael . | |
| 4,969,515 | 11/1990 | Dollison . | |
| 5,066,060 | 11/1991 | Cooksey et al. . | |
| 5,542,475 | 8/1996 | Turner et al. | 166/135 |

FOREIGN PATENT DOCUMENTS

| | | |
|---|---|---|
| 2 519 687 | 7/1983 | France . |
| 2 092 206 | 8/1982 | United Kingdom . |
| 2 272 718 | 5/1994 | United Kingdom . |
| 2 285 822 | 7/1995 | United Kingdom . |

OTHER PUBLICATIONS

Partial European Search Report (EP 95 30 4034), 4 pps.
European Search Report dated Aug. 14, 1997.

*Primary Examiner*—William Neuder
*Attorney, Agent, or Firm*—Ratner & Prestia

[57] ABSTRACT

A plug for creating a pressure barrier within an oil or gas well comprises a plug body (5) and a metal primary seal element (7) having a frusto-conical seal face (7A) adapted to engage a corresponding seal surface of a profiled well conduit to create a metal-to-metal seal having a relatively large contact area. The primary seal is energised by pressure applied above the plug, prior to the plug been set by a running tool which operates an actuating member (5) to displace locking keys (4) radially outwards so as to engage corresponding formations in the well profile and lock the plug against axial movement within the well conduit. The plug may be retrieved using a pulling tool and re-used, and includes a secondary elastomeric or polymeric seal (6).

15 Claims, 3 Drawing Sheets

METAL SEALING WIRELINE PLUG

This application is a continuation-in-part of U.S. patent application Ser. No. 08/489,043 filed Jun. 9, 1995.

The present invention relates to a plug device which finds application in creating a pressure barrier within a gas or oil well, or the like, by locating within a section of well conduit having an internal profile corresponding to the external profile of the plug. When installed, the plug creates a metal-to-metal seal between the tool and the well profile which is capable of withstanding high differential pressures. Once installed, the plug can be retrieved and re-installed repeatedly.

In this field it is already known to use wireline activated plugs which can be installed within a well in a corresponding well profile and subsequently retrieved. However, such plugs use elastomeric and/or polymeric seal elements as the primary sealing barrier, with a secondary barrier provided by a metal lip seal which is energised by differential pressure across the seal.

In the present invention, the primary seal is provided by a metal-to-metal seal, using an elastomeric/polymeric seal as an optional secondary seal barrier. The metal seal geometry creates a large contact area between the mating seal faces. This greatly improves the sealing capability of the plug at low and high pressures when exposed to liquids or gases. The metal seal is pre-energised prior to locking the plug in the well profile. The stresses trapped by the subsequent locking of the plug provide an effective seal prior to the application of differential pressure. The metal seal is re-usable over many installations and tests.

According to a first aspect of the present invention there is provided a plug for use in an oil or gas well for creation of a pressure barrier within a profiled well conduit, comprising a plug body including a primary sealing barrier formed of a metal material and holding means for holding the body in place in a well.

Preferably, said primary sealing barrier is adapted to be energised by pressure applied above said plug body once located in said well conduit.

Preferably also, said holding means is adapted to be operable by means of a running tool so as to lock said plug body against axial movement within said well conduit, following energisation of said primary sealing barrier.

Preferably also, said primary sealing barrier comprises a frusto-conical seal surface located at the forward end of said plug body, adapted sealingly to engage a corresponding frusto-conical surface of the well profile.

Preferably also, said sealing barrier further includes a no-go shoulder located rearwardly of said seal surface and adapted to engage a corresponding shoulder of said well profile so as to limit downward movement of said seal surface relative to said corresponding surface of said well profile.

Preferably also, said primary sealing barrier is provided by a metal seal element secured to the forward end of said plug body.

Preferably also, said holding means comprises a plurality of radially movable locking members each having a shoulder adapted to lock against a corresponding shoulder in the well profile.

Preferably also, said plug body is generally cylindrical and includes a blind bore extending from its rearward end towards its forward end, and said locking members are located in a corresponding plurality of apertures extending between the interior surface of said blind bore and the exterior surface of said plug body.

Preferably also, said holding means further comprises an actuating member which is axially slidable within said blind bore of said plug body between a rearward position in which said locking members may be retracted into said apertures and a forward position in which said actuating member urges said locking members radially outwardly to project beyond the outer surface of said plug body.

Preferably also, said actuating member is adapted to be engaged by a running tool for setting said plug and by a pulling tool for retrieving said plug after it has been set.

Preferably also, said plug further includes hold down means for retaining said actuating member in its forward position after the plug has been set.

Preferably also, said hold down means comprises an annular member surrounding said actuating member and including a plurality of resiliently biased locking members adapted to engage an exterior surface of said actuating member.

Preferably also, said annular member is removably attached to said plug body and is detachable therefrom by means of an upward jar force applied to said actuating member, whereby said actuating member may return to its rearward position allowing the plug to be retrieved from the well.

Preferably also, said plug further includes a secondary sealing barrier formed of an elastomeric or polymeric material.

Preferably also, said secondary sealing barrier comprises a seal stack surrounding said plug body rearwardly of said primary sealing barrier.

According to a second aspect of the present invention there is provided a method of providing a plug in a well for creation of a pressure barrier comprising providing a plug on a running tool, operating the retraction of a holding means attached to the plug by interaction of the holding means with operating means disposed on the running tool, operating the holding means when the plug is in position, and locking the holding means in place until the plug is to be withdrawn.

Preferably, the thickness of the sealing barrier can be altered to vary the amount of preload of the plug and improve the sealing barrier's integrity.

While further modifications and improvements may be made without departing from the scope of the invention, the following is a description of an example of the invention, with reference to the accompanying drawings in which.

Figure 1:
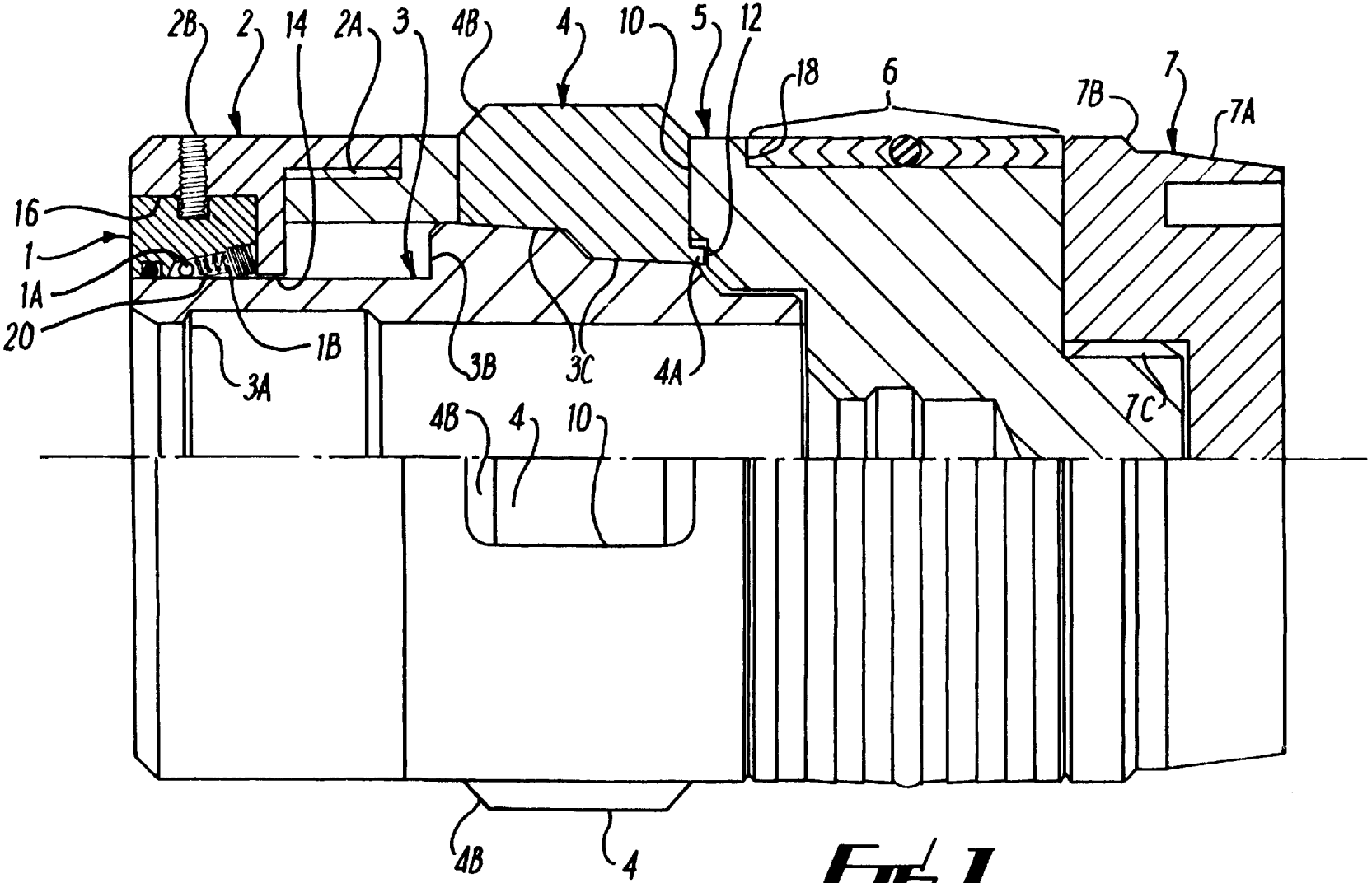
FIG. 1 is a side view, partially in section, of a wireline plug in accordance with the first aspect of the invention.

Referring now to the drawings, FIG. 1 shows a wireline plug in accordance with the invention, in which the plug is shown in its "set" position.

The main component of the plug is a key-retainer mandrel 5, to which all of the other components are attached. The mandrel 5 is generally cylindrical, having an internal blind bore, closed at the forward end of the mandrel 5.

A plurality of radially displaceable locking keys 4 are located within the bore of the mandrel 5, extending through a corresponding plurality of milled windows or apertures 10 formed in the sides of the mandrel 5. The locking keys 4 are shown extending out of the windows 10 beyond the external, cylindrical surface of the mandrel 5, in their radially outermost, "locked" position. Each of the keys 4 includes a shoulder 4A which engages a corresponding shoulder 12 on the inner surface of the mandrel 5, so as to limit the radially outward movement of the keys 5 and prevent them from falling out of the windows 10.

An actuating member comprising an expander sleeve 3 is slidably mounted within the mandrel 5 and supports the inner surfaces of the locking keys 4. The expander sleeve 3 is axially slidable between a rearward position and a forward position as illustrated. In its forward position, the expander sleeve 3 urges the locking keys 4 into their outermost, locked position, as shown. A retainer cap 2 is attached to the rear end of the mandrel 5 by any suitable means such as a screw thread 2A. The rear end of the expander sleeve 3 extends through an aperture 14 in the retainer cap 2. A generally annular hold down mechanism 1 is slidably mounted around the rearmost end of the expander sleeve 3, and is located in a counter-bore 16 formed in the rearmost end of the retainer cap 2. The hold down mechanism 1 is retained within the counter-bore 16 by means of a plurality of shear screws 2B or the like extending radially through the retainer cap 2 and spaced around the circumference thereof.

A metal primary seal element 7 is attached to the forward end of the mandrel 5, suitably by a screw thread 7C, and has a frusto-conical sealing face 7A. The metal seal element 7 is preferably formed from an alloy having an ultra-high yield strength, most preferably a titanium alloy. The ultra-high yield strength of the element 7 prevents the element from being deformed in use, allowing the plug to be re-used repeatedly without refurbishment of the primary seal.

The other components of the plug are formed from a suitable alloy, such as inconel.

A secondary elastomeric or polymeric seal barrier is provided by a seal stack 6, which is located around the body of the mandrel 5 and is retained in position between a shoulder 18 formed on the outer surface of the mandrel 5 and the metal seal element 7. The seal stack 6 includes an o-ring which seals against the inner surface of the well conduit, in use.

Figure 2:
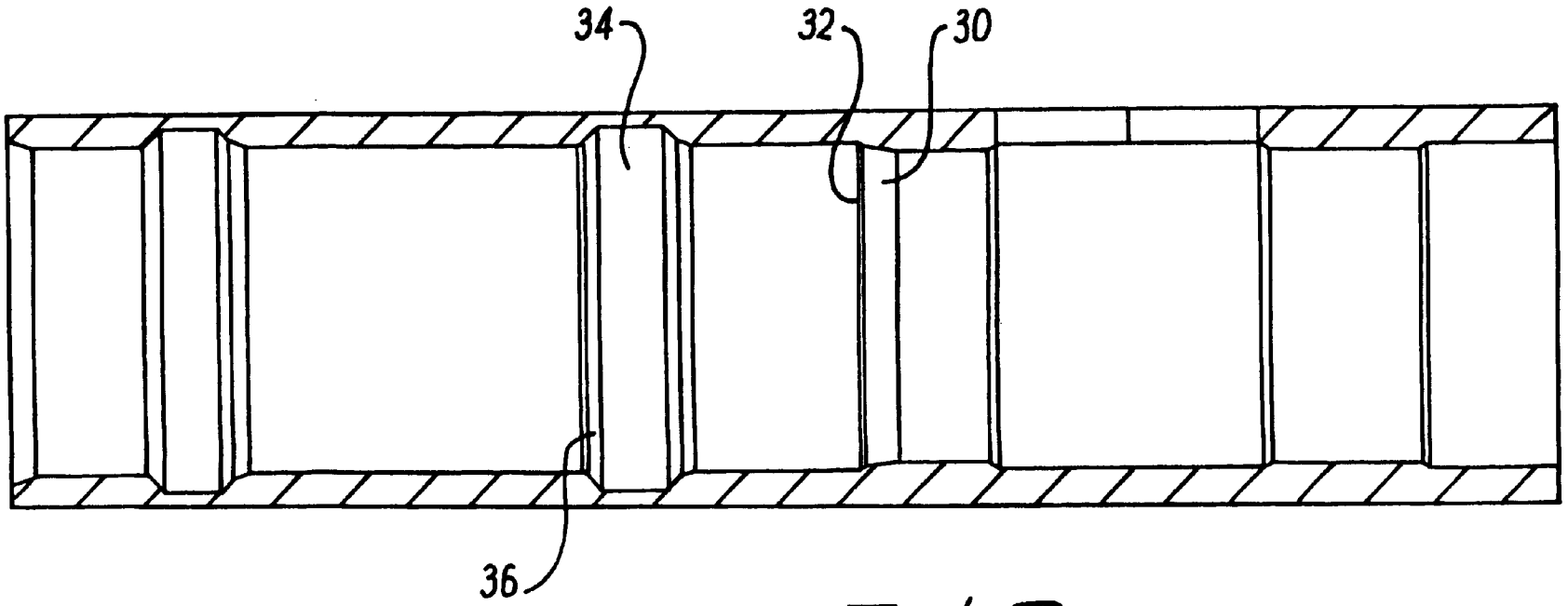
FIG. 2 is a sectional side view of a well profile configured for use with the plug of FIG. 1.

FIG. 2 illustrates a length of well conduit profiled for use with the plug of FIG. 1.

In use, the plug is attached to a dedicated running tool (not shown) on a string of well servicing tools (not shown). Running tools of this general type are well known in the art and their structure and operation will not be described in detail herein. Typically, dogs on the running tool engage a fishneck 3A on the interior surface of the expander sleeve 3. A bearing shoulder 3B on the exterior surface of the expander sleeve 3 is brought into contact with the retainer cap 2 by sliding the expander sleeve 3 towards its rearmost position. This allows the locking keys 4 to be retracted into the mandrel 5. The running tool is then pinned, using shear pins (not shown), to hold the plug components in this position.

The plug is lowered into the well conduit on the string of well servicing tools until the sealing face 7A of the metal seal 7 is brought into contact with a corresponding seal face 30 of the well profile.

Hydraulic pressure is then applied above the plug, generating a force which energises the metal seal 7 until a no-go shoulder 7B, extending around the metal seal 7 rearwardly of the seal face 7A, bottoms out on a corresponding shoulder 32 of the well profile.

Once the metal seal 7 is energised, downward jar action on the string of well servicing tools shears the pins in the running tool. This allows the expander sleeve 3 to move downwards (forwards), pushing the locking keys 4 into a corresponding portion 34 of the well profile. Tapered surfaces 3C on the exterior surface of the expander sleeve 3 lock against corresponding inner surfaces of the locking keys 4.

An upper (rearward) shoulder 4B of each locking key 4 locks against a corresponding shoulder 36 of the well profile. This maintains the plug completely static within the well profile, preventing fretting or wear of the plug components.

During the setting of the plug, the expander sleeve 3 moves downwards (forwards) through the hold down mechanism 1. The hold down mechanism includes a plurality of balls 1A located in drilled holes 20 which break through into the bore of the hold down mechanism 1. The balls 1A are held in place by springs and grubscrews 1B.

The surfaces of the balls 1A touch the exterior surface of the expander sleeve 3. As the expander sleeve 3 moves downwards (forwards) the balls 1A move backwards into the drilled holes 20 against spring pressure. Any attempt to pull the expander sleeve 3 upwards (rearwards) traps the balls 1A between the expander sleeve 3 and the drilled holes 20. This locks the expander sleeve 3 in place behind the locking keys 4, preventing inadvertent release or release by vibration.

To set the plug, a specially designed running tool (not shown) attached to the toolstring is pinned and engaged with the fishneck 3A of the expander sleeve 3. The expander mandrel 5 is driven down with the running tool by combined application of pressure and downward jarring. Upon reaching the appropriate travelling distance, whereby the plug is wedged in position by the metal seal of the no-go shoulders 7B, 32 and the keys 4 in the key-locking groove 34, the running tool can be detached from the fishneck 3A.

To release the plug, a pulling tool (not shown) on the string of well servicing tools is latched into the fishneck 3A of the expander sleeve 3. Upward jarring applied by means of the pulling tool shears the shear screws 2B securing the hold down mechanism 1 to the retainer cap 2. The expander sleeve 3 is pulled upwards (rearwards) from beneath the locking keys 4, until the bearing shoulder 3B reaches the retainer cap 2. The unsupported keys 4 are then free to move inwards, pushed by the chamfers 4B on the upper edges of the keys 4, which mate with the corresponding shoulder 36 of the well profile as previously described.

Continued upward jarring pulls the plug free of the well profile, allowing it to be retrieved to the surface. The plug can be re-used once the shear screws 2B have been replaced.

Figure 3:
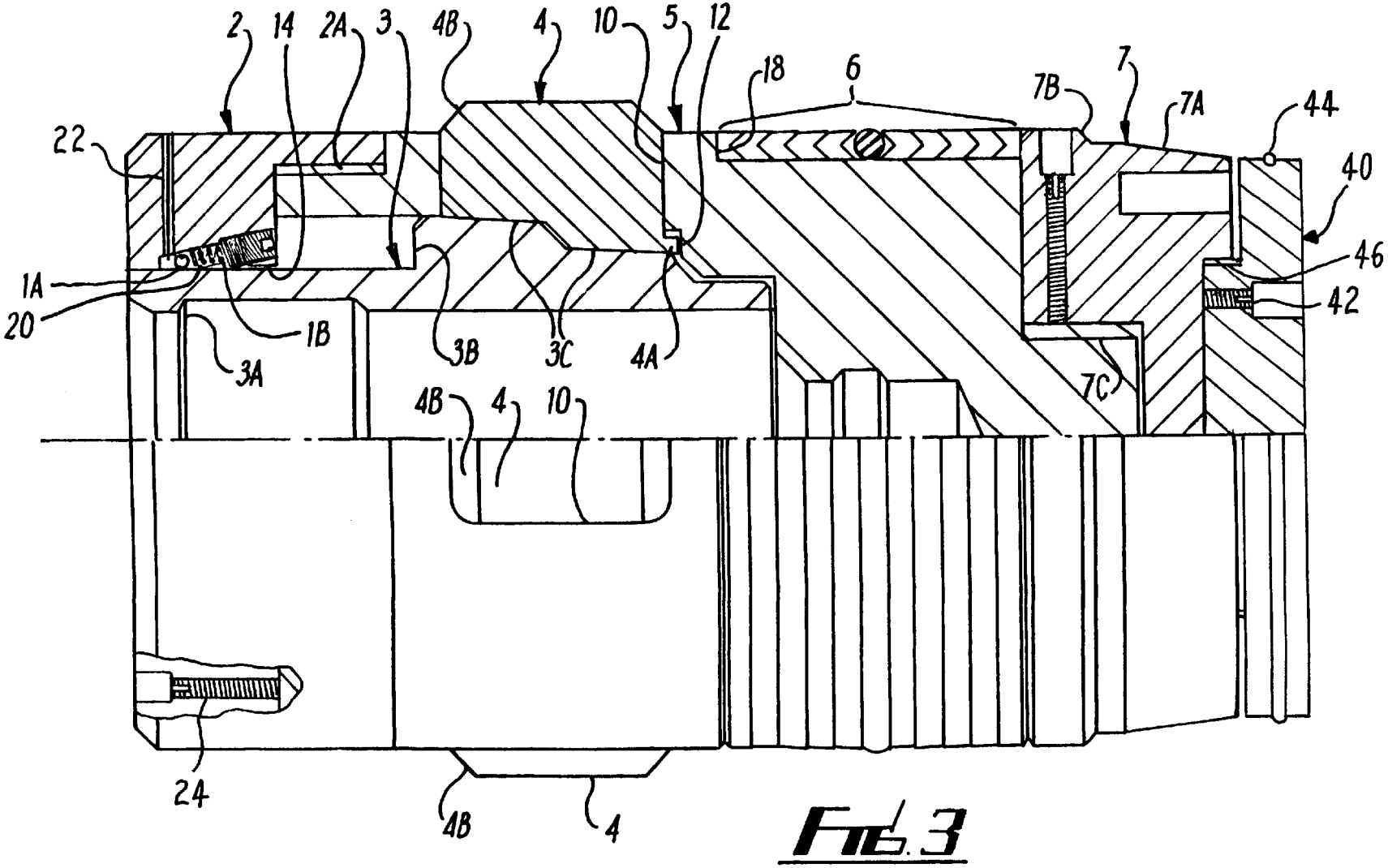
FIG. 3 is a side view, partially in section, of a wireline plug in accordance with a second aspect of the invention.

FIG. 3 shows a modified wireline plug in accordance with the invention, in which the plug is shown in its "set" position. The plug of FIG. 3 shares many common features with that of FIG. 1, and the same reference signs have been used to indicate the same components in the two plugs. However the hold down mechanism of the plug in FIG. 3 differs in that there is no separate annular member 1. Instead the ball 1A and spring 1B clutch mechanism which holds the expander sleeve 3A in place within the mandrel 5 is mounted in drilled holes 20 which are formed directly within the retainer cap 2. Retractable pins 22 which extend radially through the retainer cap 2 are provided to hold back the balls 1A of the clutch mechanism during assembly, so that the retainer cap 2 may be slid over the exterior surface of the expander sleeve 3.

One or more locking screws 24 are provided in the retainer cap 2 to pre-tension the threaded connection 2A between the retainer cap 2 and mandrel 5, so that the connection does not become loose during operation. One or more locking screws 26 are provided in the primary seal element 7 to lock the threaded connection 7C between the primary seal element 7 and mandrel 5.

An erosion target 40 is shown at the lower end of the plug. The erosion target 40 protects the primary seal element from erosion or abrasion in use and is connected to the primary seal element 7 by a threaded connection 46. A locking screw 42 pre-tensions the threaded connection 46, so that the connection does not become loose during operation. A seal 44 is provided around the erosion target 40 to seal between the target and the well profile. An erosion target may also be used with the wireline plug shown in FIG. 1.

The advantages of the invention and/or the ways in which the disadvantages of previously known arrangements are overcome include:

(a) The plug in accordance with the invention offers a primary metal seal. Prior systems use a secondary metal seal with a primary elastomeric/polymeric seal.

(b) The metal seal is pre-loaded prior to setting the plug. This greatly increases the sealing integrity of the metal seal.

(c) By altering the seal thickness, the amount of pre-load can be varied to improve the seal integrity.

(d) The seal contact area is large, making it more resistant to damage. Existing systems use point seals. By increasing the length of the metal seal face, the seal contact area can be increased.

(e) The metal seal is so designed that no permanent deformation occurs while it is pre-loaded. As the metal seal never enters a plastic deformation phase, the whole of the available strain energy is presented for sealing at all times during its life period, i.e. it has a 100% "memory".

(f) The seal has only one potential leak path across its outer diameter. Prior systems have internal and external potential leak paths.

(g) The locking mechanism of the plug keeps the plug static, preventing fretting and wear to which prior systems, which are free to move up and down relative to the well profile, are vulnerable.

Modifications and improvements may be incorporated without departing from the scope of the invention as defined in the Claims appended hereto.

I claim:

1. A plug for use in an oil or gas well for creation of a pressure barrier within a well conduit having a profiled inner surface, said plug comprising a plug body, a solid cylindrical metal primary sealing element attached to the plug-body and holding means for holding the plug body in place in said well conduit, wherein said primary sealing element has a primary sealing barrier comprising a metal tubular member located at the forward end of said primary sealing element, said tubular member being integral with and connected to said primary sealing element at the rearward end of said tubular member, the forward end of said tubular member being free, and wherein the tubular member has a thickness which reduces from said rearward end to said forward end, the outer surface of said tubular member forming a frusto-conical seal surface adapted sealingly to engage a corresponding frusto-conical portion of said profiled inner surface of the well conduit by radially inward deflection of said forward end of said tubular member, thus providing means of energisation of said primary sealing barrier.

2. A plug as claimed in claim 1, wherein said primary sealing barrier is adapted to be energized by pressure applied above said plug body once located in said well conduit.

3. A plug as claimed in claim 2, wherein said holding means is adapted to be operable by means of a running tool so as to lock said plug body against axial movement within said well conduit, following energization of said primary sealing barrier.

4. A plug as claimed in claim 3, wherein said sealing barrier further includes a no-go shoulder located rearwardly of said seal surface and adapted to engage a corresponding shoulder of said well profile so as to limit downward movement of said seal surface relative to said corresponding surface of said well profile.

5. A plug as claimed in claim 4, wherein said primary sealing element and said tubular member are formed from an alloy having an ultra-high yield strength.

6. A plug as claimed in claim 5, wherein said alloy is a titanium alloy.

7. A plug as claimed in claim 1, wherein said holding means comprises a plurality of radially moveable locking members each having a shoulder adapted to lock against a corresponding shoulder in the well conduit.

8. A plug as claimed in claim 7, wherein said plug body is generally cylindrical and includes a blind bore extending from its rearward end towards its forward end, and said locking members are located in a corresponding plurality of apertures extending between the interior surface of said blind bore and the exterior surface of said plug body.

9. A plug as claimed in claim 7, wherein said holding means further comprises an actuating member which is axially slidable within said blind bore of said plug body between a rearward position in which said locking members may be retracted into said apertures and a forward position in which said actuating member urges said locldng members radially outwardly to project beyond the outer surface of said plug body.

10. A plug as claimed in claim 9, wherein said actuating member is adapted to be engaged by a running tool for setting said plug and by a pulling tool for retrieving said plug after it has been set.

11. A plug as claimed in claim 10, further including hold down means for retaining said actuating member in its forward position after the plug has been set.

12. A plug as claimed in claim 11, wherein said hold down means comprises an annular member surrounding said actuating member and including a plurality of resiliently biased locking members adapted to engage an exterior surface of said actuating member.

13. A plug as claimed in claim 12, wherein said annular member is removably attached to said plug body and is detachable therefrom by means of an upward jar force applied to said actuating member, whereby said actuating member may return to its rearward position allowing the plug to be retrieved from the well.

14. A plug as claimed in claim 1, further including a secondary sealing barrier formed of an elastomeric or polymeric material.

15. A plug as claimed in claim 14, wherein said secondary sealing barrier comprises a seal stack surrounding said plug body rearwardly of said primary sealing barrier.

* * * * *

UNITED STATES PATENT AND TRADE MARK OFFICE

CERTIFICATE OF CORRECTION

PATENT NO. : 5,901,787
DATED : May 11, 1999
INVENTOR(S) : Boyle

It is certified that error appears in the above-identified patent and that said Letters Patent is hereby corrected as shown below:

Col 6, Line 28: should read--

9. A plug as claimed in claim 8, wherein said holding--.

Signed and Sealed this
Fourth Day of January, 2000

*Attest:*

*Attesting Officer*

*Acting Commissioner of Patents and Trademarks*